US008220919B2

(12) United States Patent
DeGruchy

(10) Patent No.: US 8,220,919 B2
(45) Date of Patent: Jul. 17, 2012

(54) ROTATIONAL AIR VALVE FOR MEDIA HOLD-DOWN TRANSPORT

(75) Inventor: Paul J. DeGruchy, Hilton, NY (US)

(73) Assignee: Xerox Corporation, Norwalk, CT (US)

( * ) Notice: Subject to any disclaimer, the term of this patent is extended or adjusted under 35 U.S.C. 154(b) by 651 days.

(21) Appl. No.: 12/421,755

(22) Filed: Apr. 10, 2009

(65) Prior Publication Data

US 2010/0259590 A1 Oct. 14, 2010

(51) Int. Cl.
*B41J 2/01* (2006.01)

(52) U.S. Cl. ..... 347/104

(58) Field of Classification Search ..... 347/104
See application file for complete search history.

(56) References Cited

U.S. PATENT DOCUMENTS 4,391,505 A * 7/1983 Silverberg ..... 399/372
4,997,178 A * 3/1991 Ogoda ..... 271/276
6,347,657 B1 * 2/2002 Bright ..... 156/556

* cited by examiner

*Primary Examiner* — Stephen Meier
*Assistant Examiner* — Alexander C Witkowski
(74) *Attorney, Agent, or Firm* — Fox Rothschild LLP

(57) ABSTRACT

A printable media hold-down system including a vacuum transport belt, an air removal device configured to create a vacuum pressure, a plurality of air ducts, wherein each air duct is configured to direct the vacuum pressure to the vacuum transport belt and at least one rotational air valve positioned between the air removal device and the plurality of air ducts, wherein the at least one rotational air valve is configured to selectively direct the vacuum pressure into one or more of the plurality of air ducts.

20 Claims, 5 Drawing Sheets

ROTATIONAL AIR VALVE FOR MEDIA HOLD-DOWN TRANSPORT

BACKGROUND

The present invention relates to printable media vacuum transport systems. More specifically, the present invention relates to rotational air valves for printable media hold-down vacuum transport systems.

Direct-to-paper ink jet printing systems typically include a printable media hold-down system. As a printable medium passes on a transport surface under an ink jet print head, the hold-down system attempts to prevent contact between the printable medium and the print head. Contact between printable media and the print head may result in fibers from printable media becoming lodged in ink nozzles in the print head. Over time, a substantial number of fibers could become lodged in the nozzles causing the print head to clog. A clogged print head can damage printable media by printing incorrectly, waste ink, and cause significant downtime if the clogged head must be cleaned and/or replaced.

Some high speed printing systems, or systems for printing larger sizes of printable media, may require a large array of print heads. A clogged print head is especially troubling when using a print head array. Cleaning and/or replacing the print heads in a print head array can cause an even greater downtime depending on the size of the print head array.

Several hold-down systems are prevalent in modern direct-to-paper printing systems. One example is a vacuum/plenum system. In this system, a series of small holes are placed in the transport surface, and air is sucked through the holes, away from the print head (or print head array). As the printable medium passes under the print head (or print head array), a vacuum is created under the printable medium, thereby holding the printable medium against the transport surface.

Vacuum hold-down systems have inherent problems, however. Specifically, vacuum hold-down systems have limits to the amount of force that can be applied across printable media to protect and prevent the printable media from coming into contact with the print head (or print head array). Vacuum hold-down systems are particularly susceptible to failure at the leading and trailing edges of the media. At the leading and trailing edges, the downward force caused by the vacuum is less than at other portions of a printable medium due to air leakage around the edges of the printable medium. Also, at the corners of the edges, the bending moment imparted by the vacuum is lowest, which can result in the corners bending away from the transport surface and contacting the print head (or print head array).

One approach to eliminate this problem is to use multiple vacuum chambers each having a separate air removal device to reduce any drop in vacuum pressure due to air escaping around the edges of a printable medium. However, the separate air removal devices are expensive and require a large amount of space, and the number of separate air chambers in current systems is limited to the number of separate air removal systems.

SUMMARY

Before the present methods are described, it is to be understood that this invention is not limited to the particular systems, methodologies or protocols described, as these may vary. It is also to be understood that the terminology used herein is for the purpose of describing particular embodiments only, and is not intended to limit the scope of the present disclosure which will be limited only by the appended claims.

It must be noted that as used herein and in the appended claims, the singular forms "a," "an," and "the" include plural reference unless the context clearly dictates otherwise. Thus, for example, reference to a "printable medium" is a reference to one or more printable media and equivalents thereof known to those skilled in the art, and so forth. Unless defined otherwise, all technical and scientific terms used herein have the same meanings as commonly understood by one of ordinary skill in the art. As used herein, the term "comprising" means "including, but not limited to."

In one general respect, the embodiments disclose a printable media hold-down system. The system includes a vacuum transport belt, an air removal device configured to create a vacuum pressure, a plurality of air ducts, wherein each air duct is configured to direct the vacuum pressure to the vacuum transport belt and at least one rotational air valve positioned between the air removal device and the plurality of air ducts, wherein the at least one rotational air valve is configured to selectively direct the vacuum pressure into one or more of the plurality of air ducts.

In another general respect, the embodiments disclose a print system. The system includes a print head array, an air removal device configured to create a vacuum pressure and a printable media hold-down system operably connected to the air removal device. The printable media hold-down system includes a vacuum transport belt, a plurality of air ducts, wherein each air duct is configured to direct the vacuum pressure to the vacuum transport belt and at least one rotational air valve positioned between the air removal device and the plurality of air ducts, wherein the at least one rotational air valve is configured to selectively direct the vacuum pressure into one or more of the plurality of air ducts.

In another general respect, the embodiments disclose a printable media hold-down system. The system includes a vacuum transport belt, at least one air removal device configured to create a vacuum pressure, a first set of air ducts, wherein each air duct in the first set of air ducts is configured to direct the vacuum pressure to the vacuum transport belt, a first rotational air valve positioned between the at least one air removal device and the first set of air ducts, wherein the first rotational air valve is configured to selectively direct the vacuum pressure into one or more air ducts of the first set of air ducts a second set of air ducts, wherein each air duct in the second set of air ducts is configured to direct the vacuum pressure to the vacuum transport belt and a second rotational air valve positioned between the at least one air removal device and the second set of air ducts, wherein the second rotational air valve is configured to selectively direct the vacuum pressure into one or more air ducts of the second set of air ducts.

BRIEF DESCRIPTION OF THE DRAWINGS

Aspects, features, benefits and advantages of the present invention will be apparent with regard to the following description and accompanying drawings, of which.

DETAILED DESCRIPTION

For purposes of the discussion below, a "printable medium" refers to a physical sheet of paper, plastic and/or other suitable substrate for printing images thereon.

A "print head array" refers to one or more print heads configured to apply ink to a printable medium.

An "air duct" refers to an enclosed area suitable for creating a vacuum when a vacuum force is applied.

An "air removal device" refers to a device capable of creating a vacuum pressure by removing the air from an enclosed space.

Figure 1:
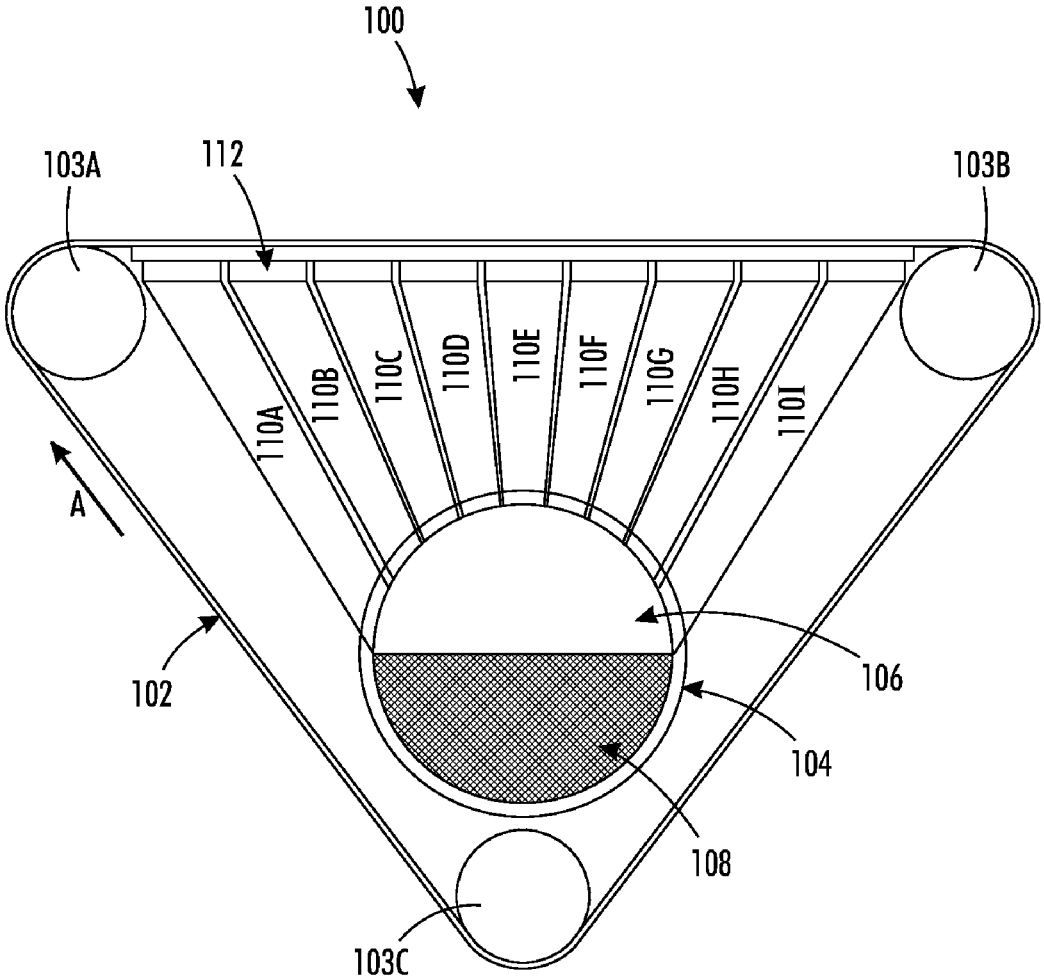
FIG. 1 illustrates various embodiments of a printable media vacuum transport having a rotational air valve.

FIG. 1 illustrates a printable media vacuum transport system 100. A vacuum transport belt 102 may travel in the direction of arrow A through vacuum transport system 100 under a print head array (not shown). Vacuum transport belt 102 may essentially be a belt that loops around, for example, three rollers, roller 103A, roller 103B and roller 103C. Vacuum transport belt 102 may be made from a porous material, or be constructed from a material filled with numerous holes, or ports, such that air flows quickly through the vacuum transport belt.

Vacuum transport system 100 also includes rotational air valve 104. Rotational air valve 104 may be configured to direct a vacuum force generated by an air removal device (not shown in FIG. 1). By directing this vacuum force, a printable medium may be held against vacuum transport belt 102 while any air leakage is reduced or eliminated. Rotational air valve 104 may be further configured to rotate in the same direction as rollers 103A, 103B and 103C, in this example clock-wise, and at a rotational velocity determined relative to the velocity of the vacuum transport belt 102. Rotational air valve 104 may be driven by an adjustable speed motor, for example, a stepper motor. A stepper motor is a motor that causes a full rotor rotation to occur as a series of steps by, for example, specific gearing or electromagnet positioning in the motor casing. By moving the rotor an identified number of steps, control of any devices attached to the stepper motor may be accurately controlled.

Rotational air valve 104 may be configured to include two distinct regions. The first region may be an open flow area 106. Open flow area 106 allows any air flow to occur when the air removal device is operating. In contrast to open flow area 106, a closed flow area 108 is provided. Unlike open flow area 106, closed flow area 108 prevents any air flow when the air removal device is operating.

A series of air ducts, such as 110A-I, may be included to direct vacuum pressure from the rotational air valve 104, or more particularly open flow area 106, toward the vacuum transport belt 102. Between air ducts 110A-I and vacuum transport belt 102 may be a series of open channel ribs, such as open channel ribs 112. These open channel ribs 112 may be aligned in the process direction, or the same direction as vacuum transport belt 102 travels, to provide support for the vacuum transport belt while still providing a means for the vacuum pressure caused by the air removal device to reach the vacuum transport belt.

It should be noted that in the exemplary system 100 illustrated in FIG. 1, rotational air valve 104 is split evenly, where 180 degrees is the open flow area 106, and 180 degrees is the closed flow area 108. This is shown by way of example only. Other configurations may be utilized, such as 240 degrees for the open flow area and 120 degrees for the closed flow area. The ratio of open flow area to closed flow area may be determined by the number of vacuum ducts, size of the printable media being held down, and various other factors.

Figure 2A:
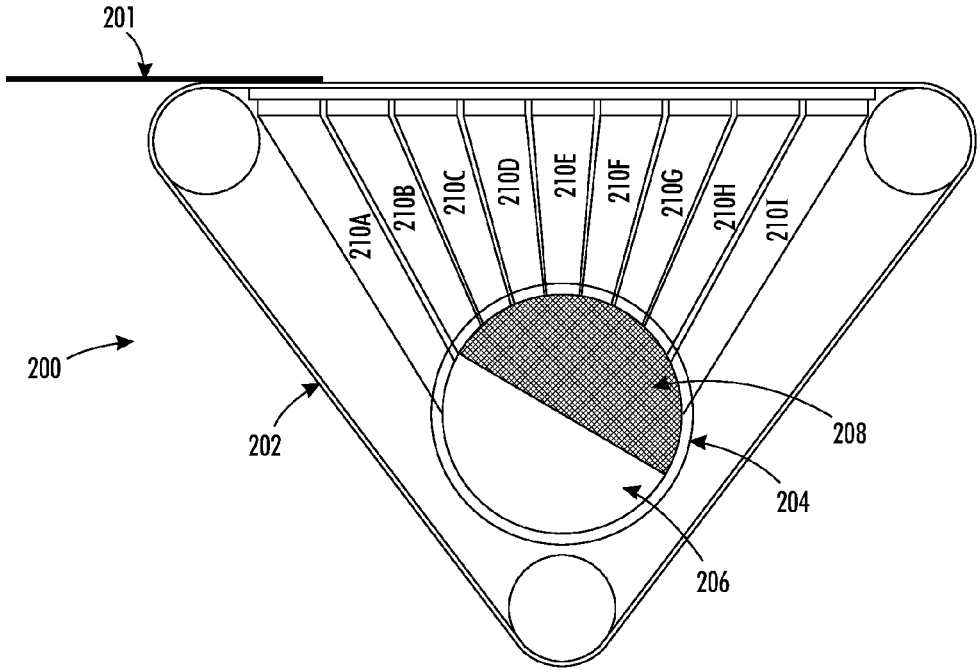
FIGS. 2*a*-2*d* illustrate various embodiments of a printable medium traveling on a vacuum transport belt having a rotational air valve such as the one illustrated in FIG. 1.

FIGS. 2*a*-2*d* illustrate various views of the operation of an exemplary printable media vacuum transport system 200 as a printable medium 201 passes over vacuum transport belt 202. FIG. 2*a* shows system 200 as printable medium 201 first begins to pass over one of the plurality of air ducts 210A-I. Rotational air valve 204 is positioned such that open flow area 206 is only directing vacuum pressure to duct 210A as printable medium 201 is only over duct 210A. An edge sensor (shown in FIG. 3) may be included that may detect the position and velocity of printable medium 201 as it approaches system 200. As printable medium 201 passes onto vacuum transport belt 202, the rotational air valve 204 may begin rotating at a rotational velocity based on the velocity of printable medium 201, e.g., a rotational velocity that will result in each air duct (i.e., ducts 210A-I) receiving vacuum pressure from open flow area 206 as the printable medium passes over the corresponding air duct. In FIG. 2*a*, air ducts 210B-I may not receive any vacuum pressure as closed flow area 208 may prevent any air flow through those air ducts.

Figure 2B:
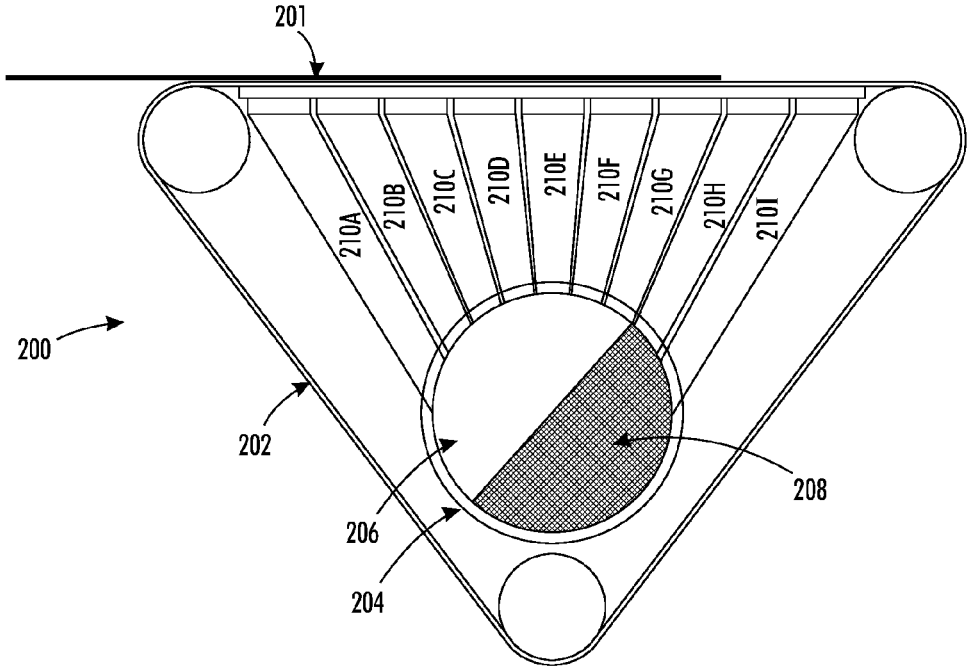

FIG. 2*b* shows system 200 as printable medium 201 passes further along vacuum transport belt 202. As shown in FIG. 2*b*, printable medium 201 may cover air ducts 210A-G. As printable medium 201 advanced along vacuum transport belt 202, rotational air valve 204 may rotate at a rotational velocity based on the velocity of the printable medium, thereby providing vacuum pressure to each air duct as the printable medium passes overhead. Specifically, as printable medium 201 passes overhead, rotational air valve 204 may rotate such that, in order, air duct 210B may receive vacuum pressure as it is exposed to open flow area 206, creating a vacuum hold down effect at vacuum transport belt 202. Air duct 210C may receive vacuum pressure as rotational air valve 204 continues to rotate, followed by air ducts 210D, 210E, 210F and 210G. In this example, only air ducts 210H and 210I may be blocked from receiving vacuum pressure by closed flow area 208.

Figure 2C:
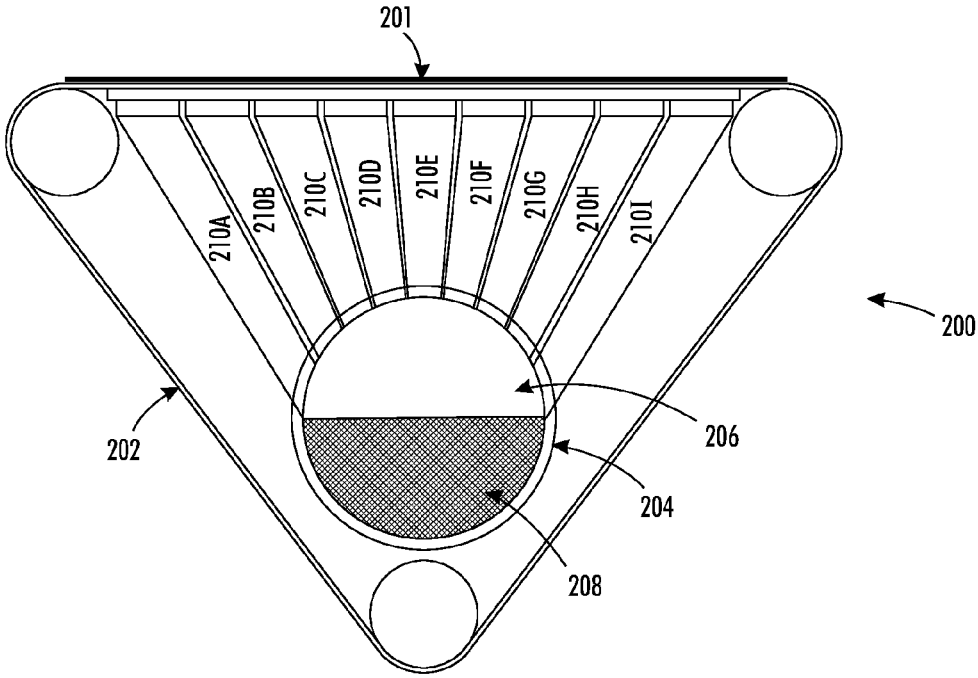

FIG. 2*c* shows system 200 as printable medium 201 has advanced along vacuum transport belt 202 such that it may cover each of the air ducts 210A-I. In this example, rotational air valve 204 may be rotated such that open flow area 206 may provide vacuum pressure to each of the air ducts 210A-I. Similarly, rotational air valve 204 may be rotated such that closed flow area 208 may not block vacuum pressure from any of the air ducts 210A-I. It should be noted that based upon the size of printable medium 201, rotational air valve 204 may be held in this position as printable medium passes over the air ducts 210A-I. In an embodiment, a specific degree of rotation for a stepper motor may be used to cease rotation of the rotational air valve 204 for a time period. Alternatively, a controller may be used to variably control the rotation of the rotational air valve. If a specific degree of rotation for a stepper motor is incorporated, the degree of rotation of the stepper motor may be based upon the size of the printable media being used such that as each individual printable medium passes through the vacuum hold down system, rotational air valve 204 performs an identical rotation pattern. If a controller is incorporated for controlling the rotation of rotational air valve 204, an edge sensor may detect a trailing edge of the printable medium 201, indicating the rotational air valve may again resume rotation. It should be noted that a stepper motor for rotating the rotational air valve is shown by way of example only. Any suitable motor or driving mechanism may be incorporated to cause the movement of the rotational air valve.

Figure 2D:
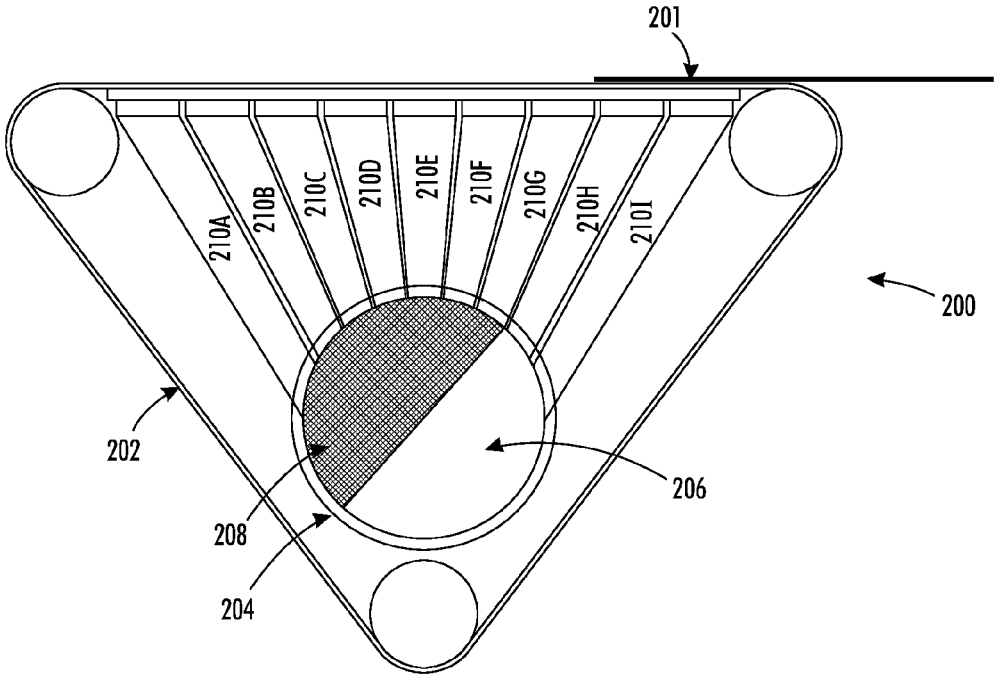

FIG. 2*d* shows system 200 as printable medium 201 continues along transport 202 and exits the system. In this example, printable medium 201 may only cover one or more of the rightmost air ducts, such as air ducts 210H and 210I. Rotational air valve 204 may be rotated such that open flow area 206 directs the vacuum force to air ducts 210H and 210I while closed flow area 208 blocks air ducts 210A-G.

Figure 3:
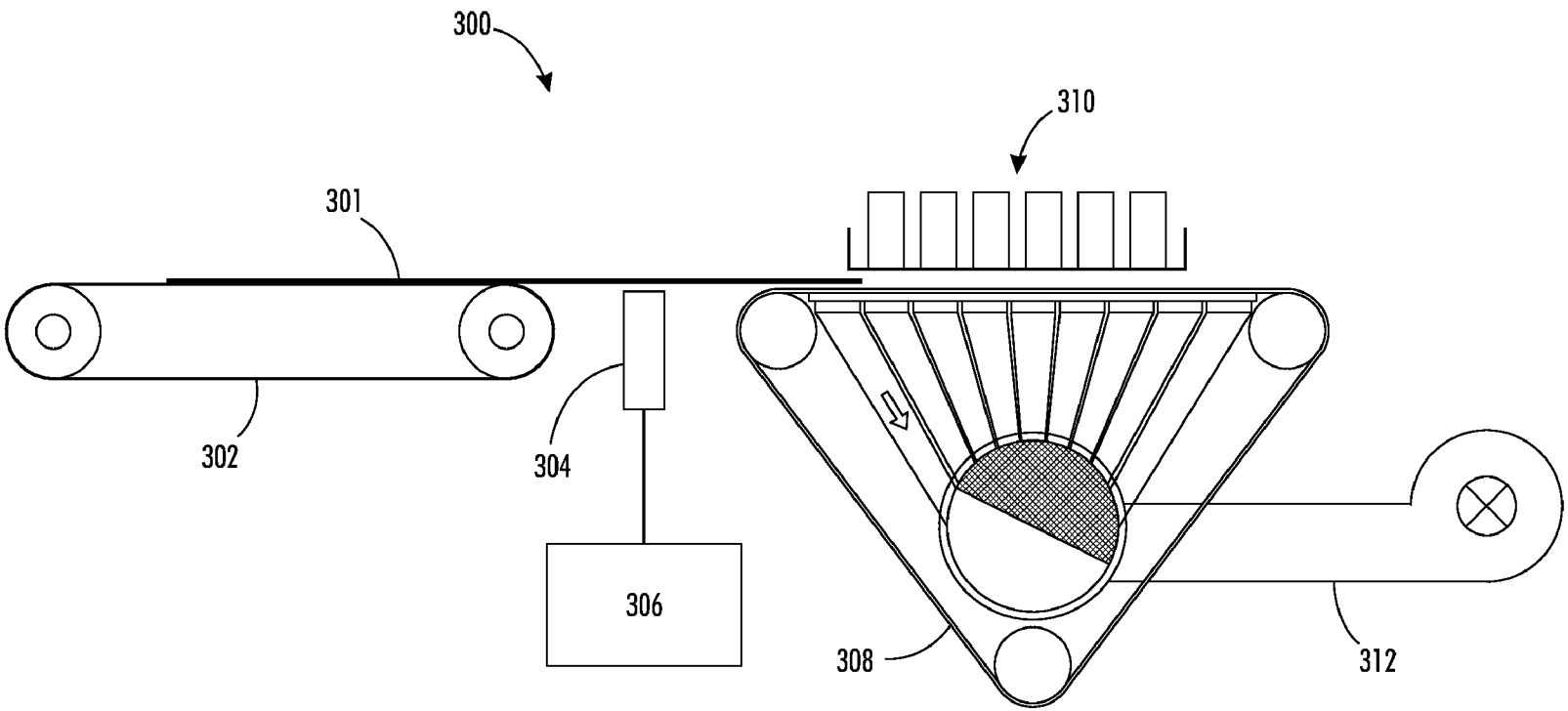
FIG. 3 illustrates a print system including a printable media vacuum transport system such as the one described in FIG. 1.

FIG. 3 shows a print system 300. Printable medium 301 may enter print system 300 on a transport belt 302. Similarly, printable medium 301 may enter print system 300 directly from a media feeder (not shown). Printable medium 301 may pass over an edge sensor 304. Edge sensor 304 may detect the leading edge of printable medium 301 as the printable medium arrives at vacuum hold down system 308. Alternatively or additionally, edge sensor 304 may detect the trailing edge as printable medium 301 fully passes onto vacuum hold down system 308.

Edge sensor 304 may be electrically connected to controller 306. Controller 306 may be a dedicated processor and memory for storing and processing information related directly to print system 300. Alternatively, controller 306 may be a shared processor configured to operate an entire printing device.

Edge sensor 304 may communicate the arrival of the leading edge and/or the trailing edge of printable medium 301 to controller 306. Controller 306 may instruct the rotational air valve of vacuum hold down system 308 to rotate accordingly to accommodate either the arrival or departure of the printable medium to or from the vacuum hold down system, thereby directing vacuum pressure created by air removal device 312 towards the vacuum transport belt 308 of the vacuum hold down system such that printable medium 301 is held down against the vacuum transport belt.

As printable medium 301 passes onto vacuum hold down system 308, it may pass under print head array 310 where an image, text or a combination of the two are printed onto the printable medium. Printable medium 301 continues through vacuum hold down system 308 and eventually exits print system 300.

It should be noted that in print system 300, air removal device 312 may be a shared device with additional vacuum hold down systems. Air removal device 312 may also be continuously on, regardless of the presence of a printable medium on or near vacuum hold down system 308, or may be variably operated by controller 306, turned on as a printable medium nears the vacuum hold down system.

Figure 4:
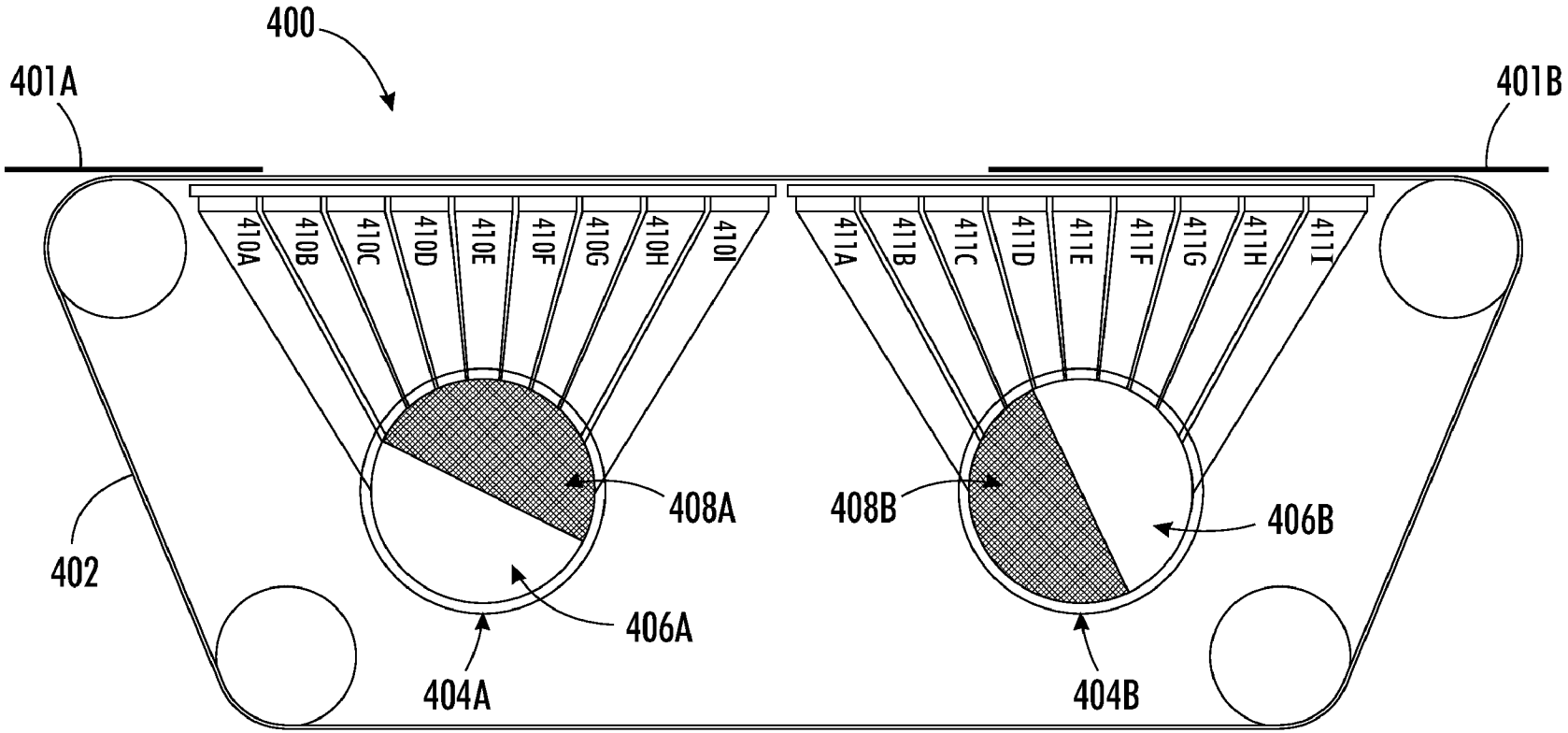
FIG. 4 illustrates various embodiments of a printable media vacuum transport system having multiple rotational air valves.

FIG. 4 illustrates an exemplary printable media vacuum transport system 400 incorporating multiple rotational air valves 404A and 404B. In this example, printable media 401A and 401B may be in various stages of passing through system 400. Printable medium 401A may be just beginning to proceed along vacuum transport belt 402 over air ducts 410A-I. As before, when printable medium 401A passes over the various air ducts, rotational air valve 404A may rotate accordingly such that open flow area 406A directs vacuum pressure to the appropriate air duct, in this example, air duct 410A. Conversely, air ducts 410B-I are blocked from receiving any vacuum pressure by closed flow area 408A.

Printable medium 401B may be further along vacuum transport belt, nearing the exit of system 400. Printable medium 401B may be passing over rotational air valve 404B. As before, rotational air valve 404B is rotated such that open flow area 406B may provide vacuum pressure to air ducts 411D-I, while closed flow area 408B may block vacuum pressure from air ducts 411A-C.

It should be noted that two rotational air valves (i.e., rotational air valves 404A and 404B) are shown in FIG. 2 by way of example only. Additional rotational air valves may be positioned proximate to each other with a single vacuum transport belt depending on the size of the print head array or various other variables. Similarly, multiple vacuum transport belts may be placed proximate to each other such that each vacuum transport belt encloses one or more rotational air valve assemblies. Additionally, one or more air removal devices may be used to create the vacuum pressure directed by the rotational air valves. For example, in FIG. 4, both rotational air valves 404A and 404B may be connected to the same air removal device, or each may have an independent air removal device.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A printable media hold-down system, the system comprising:

a vacuum transport belt;

an air removal device configured to create a vacuum pressure;

a plurality of air ducts, wherein each air duct is configured to direct the vacuum pressure to the vacuum transport belt; and at least one rotational air valve positioned between the air removal device and the plurality of air ducts, wherein the at least one rotational air valve is configured to selectively direct the vacuum pressure into one or more of the plurality of air ducts.

2. The system of claim 1, wherein the at least one rotational air valve is configured to rotate in correlation with movement of a printable medium on the vacuum transport belt.

3. The system of claim 1, wherein the at least one rotational air valve comprises an open air flow area and a closed air flow area.

4. The system of claim 3, wherein the open air flow area is approximately equal in size to the closed air flow area.

5. The system of claim 1, further comprising:

a stepper motor configured to cause rotation of the at least one rotational air valve for a first period of time.

6. The system of claim 5, wherein the stepper motor is further configured to not cause rotation of the at least one rotational air valve for a second period of time when each air duct is directing the vacuum pressure to the vacuum transport belt.

7. A print system, the system comprising:

a print head array;

an air removal device configured to create a vacuum pressure; and a printable media hold-down system operably connected to the air removal device, the system comprising:

a vacuum transport belt, a plurality of air ducts, wherein each air duct is configured to direct the vacuum pressure to the vacuum transport belt; and at least one rotational air valve positioned between the air removal device and the plurality of air ducts, wherein the at least one rotational air valve is configured to selectively direct the vacuum pressure into one or more of the plurality of air ducts.

8. The system of claim 7, wherein the at least one rotational air valve is configured to rotate in correlation with movement of a printable medium on the vacuum transport belt.

9. The system of claim 7, further comprising an edge sensor configured to detect one or more of the following:

a leading edge of a printable medium; and a trailing edge of a printable medium.

10. The system of claim 9, further comprising a controller operably connected to the edge sensor and configured to receive information from the sensor.

11. The system of claim 10, wherein the controller is further configured to determine the operation of the at least one rotational air valve based upon the received information.

12. The system of claim 7, wherein the at least one rotational air valve comprises an open air flow area and a closed air flow area.

13. The system of claim 12, wherein the open air flow area is approximately equal in size to the closed air flow area.

14. The system of claim 13, wherein the stepper motor is further configured to not cause rotation of the at least one rotational air valve for a second period of time when each air duct is directing the vacuum pressure to the vacuum transport belt.

15. The system of claim 7, further comprising:

a stepper motor configured to cause rotation of the at least one rotational air valve for a first period of time.

16. A printable media hold-down system, the system comprising:

a vacuum transport belt;

at least one air removal device configured to create a vacuum pressure;

a first set of air ducts, wherein each air duct in the first set or air ducts is configured to direct the vacuum pressure to the vacuum transport belt;

a first rotational air valve positioned between the at least one air removal device and the first set of air ducts, wherein the first rotational air valve is configured to selectively direct the vacuum pressure into one or more air ducts of the first set of air ducts;

a second set of air ducts, wherein each air duct in the second set of air ducts is configured to direct the vacuum pressure to the vacuum transport belt; and a second rotational air valve positioned between the at least one air removal device and the second set of air ducts, wherein the second rotational air valve is configured to selectively direct the vacuum pressure into one or more air ducts of the second set of air ducts.

17. The system of claim 16, wherein the first rotational air valve and the second rotational air valve are each configured to rotate in correlation with movement of a printable medium on the vacuum transport belt.

18. The system of claim 16, wherein the first rotational air valve and the second rotational air valve each comprise an open air flow area and a closed air flow area.

19. The system of claim 18, wherein the open air flow area is approximately equal in size to the closed air flow area.

20. The system of claim 16, further comprising:

a first stepper motor configured to cause rotation of the first rotational air valve for a first period of time; and a second stepper motor configured to cause rotation of the second rotational air valve for a second period of time.

* * * * *